US005660422A

United States Patent [19]

Knisley

[11] Patent Number: 5,660,422

[45] Date of Patent: Aug. 26, 1997

[54] ADJUSTABLE LIFTING DEVICE

[76] Inventor: Jon C. Knisley, 4569 Clifton Ave., Lorain, Ohio 44055

[21] Appl. No.: 699,973

[22] Filed: Aug. 20, 1996

[51] Int. Cl.[6] ..... B66C 1/54; B66C 1/66

[52] U.S. Cl. ..... 294/67.33; 294/90; 294/93

[58] Field of Search ..... 294/63.1, 67.1, 294/67.21, 67.3, 67.33, 67.5, 81.1, 81.2, 81.21, 81.3, 81.4, 81.5, 81.54, 81.62, 90, 93, 94, 103.1, 119.1

[56] References Cited

U.S. PATENT DOCUMENTS

| | | | |
|---|---|---|---|
| 1,736,016 | 11/1929 | Rosener | 294/119.1 X |
| 1,807,360 | 5/1931 | Wehr | 294/119.1 X |
| 2,370,528 | 2/1945 | Fontaine | 294/63.1 X |
| 3,028,186 | 4/1962 | Skubic . | |
| 3,206,243 | 9/1965 | Miles . | |
| 3,401,973 | 9/1968 | Marshall . | |
| 3,670,912 | 6/1972 | Dunbar . | |
| 3,751,097 | 8/1973 | Jones et al. . | |
| 3,847,339 | 11/1974 | Farrell . | |
| 3,995,903 | 12/1976 | Ernst . | |
| 4,336,962 | 6/1982 | Read | 294/67.33 X |
| 4,371,203 | 2/1983 | Munro . | |
| 4,458,949 | 7/1984 | Jury . | |
| 4,538,956 | 9/1985 | Kalkbrenner et al. | 294/67.33 X |
| 4,619,475 | 10/1986 | Sylvest | 294/67.3 X |
| 4,696,503 | 9/1987 | Collodel . | |
| 5,306,062 | 4/1994 | Dodge | 294/67.33 X |
| 5,476,300 | 12/1995 | Dodge . | |

FOREIGN PATENT DOCUMENTS

| | | | |
|---|---|---|---|
| 2492796 | 4/1982 | France | 294/67.33 |
| 3264494 | 11/1991 | Japan | 294/93 |
| 441389 | 2/1992 | Japan | 294/93 |
| 158332 | 3/1957 | Sweden | 294/93 |
| 1033497 | 6/1966 | United Kingdom | 294/93 |

*Primary Examiner*—Johnny D. Cherry

*Attorney, Agent, or Firm*—Pearne, Gordon, McCoy & Granger LLP

[57] ABSTRACT

An adjustable lifting device for lifting a manhole casting. The device has two endpieces each having a lifting flange for engaging and lifting the manhole casting. One endpiece is extended into engagement with the casting by one or more springloaded telescoping extension arms. Once positioned, the device is lockable to prevent retraction of the extension arm(s). A slidable and lockable collar is provided for effectuating balancing of the device and casting. Each endpiece has a safety stop to prevent the device from dropping into the casting once the lifting flanges are positioned beneath the inner ledge of the casting.

16 Claims, 2 Drawing Sheets

ADJUSTABLE LIFTING DEVICE

BACKGROUND OF THE INVENTION

This invention relates generally to adjustable lifting devices and more particularly to a lifting device for lifting manhole castings and storm drain castings.

DESCRIPTION OF RELATED ART

Manholes and manhole covers are well-known and are located in streets throughout America and other parts of the world. The manhole itself is a structure that is usually made by laying up layers of brick into a circular structure complete with an interior ladder that permits access to underground telephone lines, sewers, etc. The top of the brick portion has placed thereon an annular cover called a "manhole casting" which is typically a cast iron cylindrical unit provided with a flat base or flange which rests on the upper surface of the bricked-up manhole. It typically weighs in the range of 300–500 pounds, and the flange is covered with cement, etc., so as to prevent the casting from moving with respect to the manhole and the road surface. The casting receives a manhole cover or lid.

When a street is being repaired, frequently the manhole cover and manhole casting must be removed, the street repaired, and the casting and cover reinstalled. The cover typically weighs 80 pounds and can be removed by hand. However, the casting is much heavier and cannot be removed by hand.

Similar to a manhole casting is a storm drain casting (typically weighing 300 pounds), which may or may not be provided with a curb box (typically weighing 120 pounds); these storm drain castings must also be installed and reinstalled in a manner similar to manhole castings.

Due to their great weight, it is difficult to initially install manhole castings and storm drain castings. In addition, when a street or other area is being repaired, it has been found to be very difficult to remove these castings and later reinstall them after the repair or resurfacing.

Various devices have been suggested in the prior art for lifting manhole castings, including U.S. Pat. Nos. 5,476,300; 4,458,949; 3,847,339; and 3,401,973, the contents of all of which are incorporated herein by reference in their entirety. However, these devices are difficult to use, are time-consuming, are insufficiently adjustable, and/or suffer from various other deficiencies.

There is a need for an adjustable lifting device which can be quickly and effectively attached to manhole castings and storm drain castings to lift and move them during installation and reinstallation. There is also a need for such a device which is adjustable to accommodate various diameters of castings.

SUMMARY OF THE INVENTION

An adjustable lifting device for lifting a manhole casting having an inner ledge is provided. The device includes a crosspiece joining a first endpiece and a center support, the first endpiece and the center support also being joined by a tube. A first extension arm is slidable within the tube and extendable therefrom; the first extension arm is also connected to a second endpiece. Each of the first and second endpieces has a lifting flange attached thereto, each of the lifting flanges being engageable with the inner ledge of the manhole casting so that the device is capable of lifting the manhole casting.

DETAILED DESCRIPTION OF THE PREFERRED EMBODIMENTS OF THE INVENTION

Figures 1, 2:
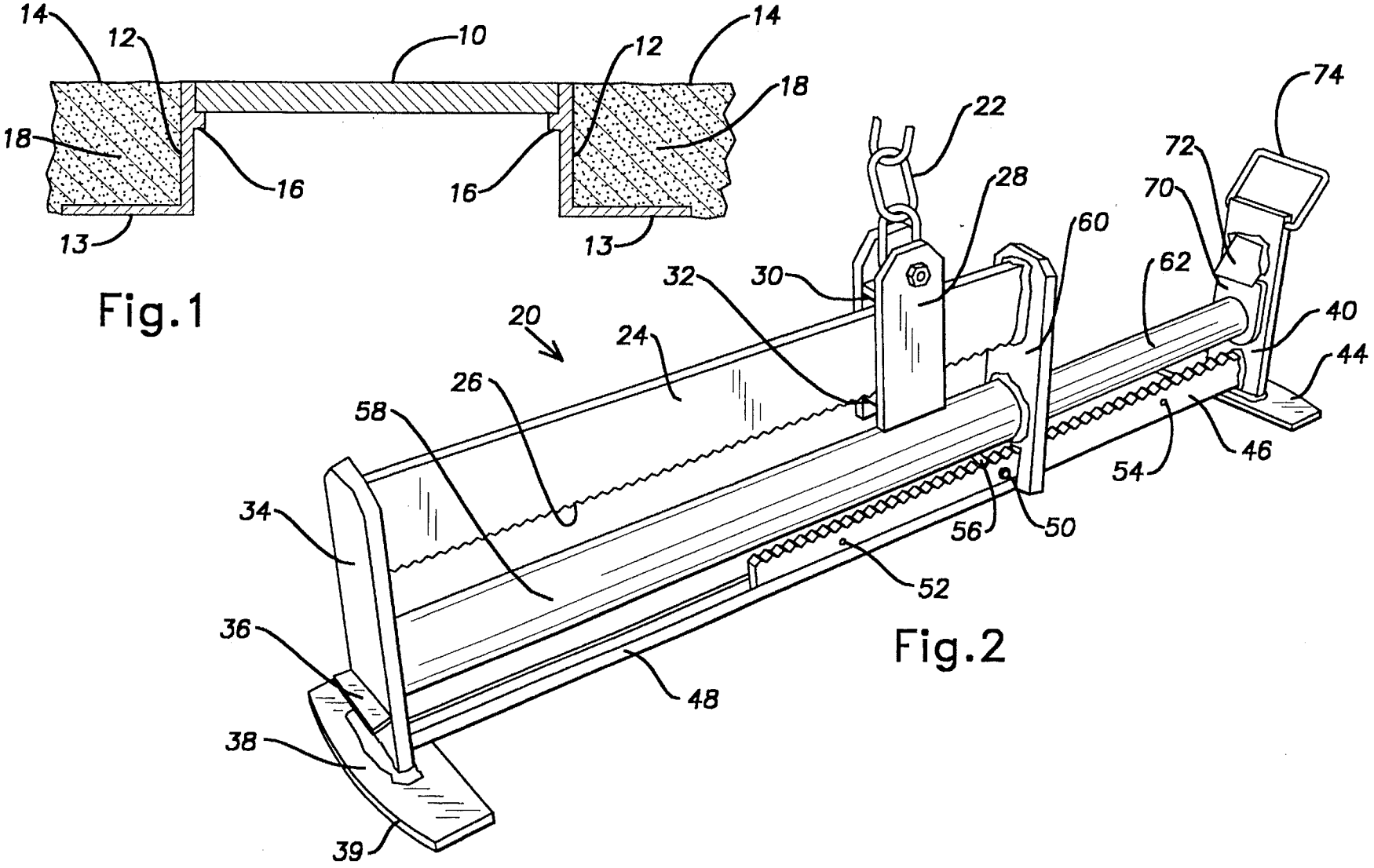
FIG. 1 is a cross sectional view of a manhole casting, with lid, buried in a street.
FIG. 2 is a perspective view of the adjustable lifting device of the present invention, partially extended.
Figure 3:
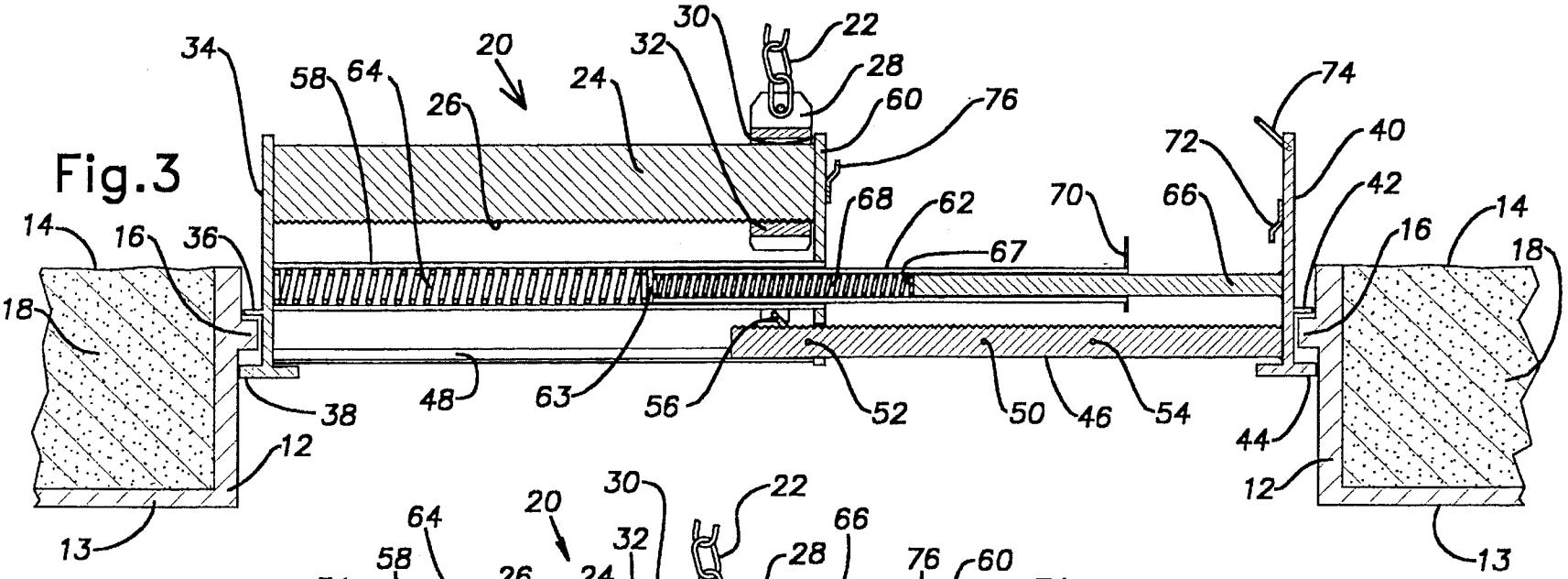
FIG. 3 is an elevational view, in cross section, of the lifting device of FIG. 2 shown in an extended position engaging a manhole casting.
Figure 4:
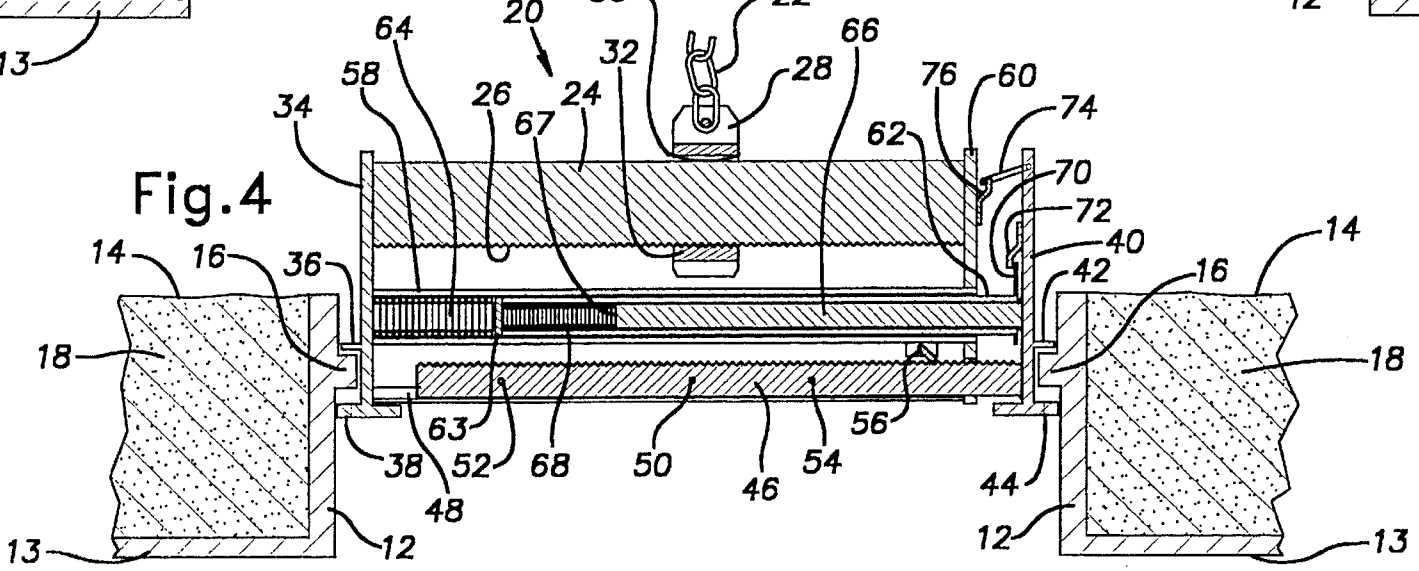
FIG. 4 is an elevational view, in cross section, of the lifting device of FIG. 2 shown in a retracted position engaging a manhole casting.

With reference to FIGS. 1, 3 and 4, there is shown a manhole casting 12 having an inner ledge 16 and a base flange 13. The casting 12 is cylindrical in shape and thus the ledge 16 and flange 13 are annular. Resting on the ledge 16 is a circular or disc-shaped manhole cover or lid 10. The street level is shown at 14 and the asphalt or gravel material 18 making up the street is shown resting on the flange 13 to hold the casting in place.

With reference to FIGS. 2–4, there is shown the adjustable lifting device 20 of the present invention. The device has a chain 22 which is attached to the extended arm of a backhoe or similar machine for lifting the device and casting. The device 20 has an upper crosspiece 24 having a rack or teeth 26 on its under surface. A slidable lifting collar 28 surrounds and slides along the crosspiece 24. Near the bottom of the collar 28 is a rack or teeth 32 which is biased in engagement with the rack 26 by rack engaging or biasing spring 30. The lifting collar 28 is thus in slidable and lockable engagement with crosspiece 24.

The crosspiece 24 is attached to and joins the first endpiece 34 and the center support 60. The first endpiece 34 has a first safety stop or flange 36 and a first lifting flange 38 which has a curved outer edge 39 (to accommodate the inner curved surface of a manhole casting, such as a 30 inch diameter casting). On its opposite end, the device has a second endpiece 40 having a second safety stop or flange 42 and a second lifting flange 44 (also having a curved edge). Attached to the second endpiece 40 is bottom rack gear slide bar 46 (having a rack or teeth on its upper surface) which slides in a rack guide 48. The upper edges of the rack guide 48 may have out-turned flanges to prevent sideways bending or flexing. The slide bar 46 has three apertures or holes 50, 52, 54 for an adjusting stop pin. Preferably, there are three apertures; less preferably 2–10 apertures spaced apart. These apertures or holes may be horizontal slots, and the adjusting pin may be a weighted key which turns downward 90° after being pushed through the slot. Optionally, the stop pin may be a nutted bolt (as shown at 50 in FIG. 2), etc. As shown in FIG. 2, the adjusting stop pin may be placed in hole 50 to prevent the slide bar 46 from further extending, thus presetting the lifting device for use in a certain diameter casting. An adjusting stop pin should be placed in one of the holes to prevent the slide bar from sliding out of the device. The device has a swingable rack position lock 56 which engages the teeth on the upper surface of slide bar 46, the slide bar 46 thus being lockable to prevent retraction of the slide bar 46 and the second endpiece 40 once the telescoping arms are extended and the casting is engaged.

The device 20 has a fixed tube 58 (preferably circular cross-section; less preferably square, rectangular, etc. cross-section) which joins and is attached to the first endpiece 34 and the center support 60. Slidable within the fixed tube 58 is a major spring 64 and a first extension arm or extension tube 62 having a closed end 63. The major spring 64 is biased against the closed end 63 and actuates extension tube 62. Slidable within the extension tube 62 is a minor spring 68 and a second extension arm or extension rod 66 (preferably hardened steel and solid circular cross section) having an end 67 biased against the minor spring 68. Minor spring 68 actuates extension rod 66. Second extension arm or extension rod 66 is attached to second endpiece 40, although less preferably extension rod 66 can be hollow and further spring-loaded telescoping extension arms can be added to connect extension rod 66 to second endpiece 40. First extension arm 62 is connected to second endpiece 40 by second extension arm 66; less preferably first extension arm 62 can be directly connected to or attached to or welded to second endpiece 40, eliminating second extension arm 66.

The extension tube 62 is rotatable so that locking element or flange 70 may be rotated into locking engagement with closed position extension tube lock 72 attached to second endpiece 40. When the additional extension of extension rod 66 is not needed, locking flange 70 is locked into extension tube lock 72. The device is held in its fully retracted position by latching closed position latch 74 onto latch lock 76.

Most manhole castings and storm drain castings have an inside diameter of 24–36 inches. In its fully retracted position, the device 20 extends preferably 20–22 inches and when fully extended extends preferably 37–40 inches. Longer and shorter sizes may also be made.

The device operates as follows. The device is lowered into the casting, such as a manhole or storm drain casting. The spring-loaded extension tube 62 and extension rod 66 are then extended so that the device engages the ledge 16 inside the casting. As can be seen, tube 62 and rod 66 are actually telescoping sections inside tube 58. Major spring 64 is stronger than minor spring 68 and thus dominates over it, as is known in the art. The device engages the ledge 16 as follows. The device has a first lifting flange 38 and a second lifting flange 44. The device also has a first safety stop or flange 36 and a second safety stop or flange 42. The device engages the ledge 16 so that the lifting flanges 38, 44 are positioned beneath the ledge 16 and the safety stops 36, 42 are above the ledge 16. The lifting flanges are for lifting the casting; the safety stops prevent the device 20 from falling down or dropping inside the casting. Each end of the device 20 is thus locked around the ledge 16, as shown in FIG. 3.

When the device is fully extended inside the casting and locked around the ledge, rack position lock 56 engages the rack or teeth of slide bar 46 to lock the device in place so it cannot accidentally retract and drop the casting.

Once the device has engaged or attached to the casting and been locked in place, the device is approximately balanced. The lifting collar 28 is slid along upper crosspiece 24 until it is above approximately the center of gravity of the casting. At this point rack engaging spring 30 biases the rack or teeth 32 projecting up from the bottom of the collar 28 against the rack or teeth 26 on the under side of crosspiece 24, thus locking the collar 28 in place. This prevents collar 28 from sliding along crosspiece 24 (which could cause the device to tilt and possibly drop the casting). The collar 28 is attached by chain 22 to the arm of a backhoe or similar machine. The backhoe arm then lifts the device, which lifts the casting by means of the flanges 38, 44 engaging the under side of the ledge 16. The casting does not tip because the collar 28 is centered and cannot slide along crosspiece 24.

The backhoe then deposits the casting at a safe location from the manhole, etc. The street and/or manhole is then repaired, and the backhoe then lifts the casting and redeposits and repositions it in the manhole. The street is then replaced around the casting, and the cover 10 is put in place.

If the manhole casting is cylindrical and evenly balanced, the collar 28 is positioned in the center of the casting, which would be closer to center support 60 as the extension arms 62, 66 are extended. However, if the casting is not uniformly balanced, such as a storm drain casting without a curb box or a storm drain casting with a curb box, first endpiece 34 is positioned on the heavy side, because endpiece 34 is on the stronger side of the device (the telescoping sections could get bent if subjected to excessive strain), and if the unbalanced condition is extreme, the collar 28 could be positioned adjacent endpiece 34 to balance the unit.

The device 20 is preferably capable of lifting 800 pounds, and is capable of lifting circular, rectangular, or other shapes of manhole and storm drain castings, including storm drain castings with and without a curb box. Marks can be placed on the crosspiece 24 so that the collar 28 can be preset for standard or known sizes of castings. In a preferred embodiment, the extension tube 62 extends to about 30 inches, while the extension rod 66 can extend the device to about 36 inches.

Although the preferred embodiments have been described, it is understood that various modifications and replacements of the components and methods may be resorted to without departing from the scope of the invention as disclosed and claimed herein.

What is claimed is:

1. An adjustable lifting device for lifting a manhole casting having an inner ledge, said device comprising crosspiece immovably fixed to a first endpiece and immovably fixed to a center support and a tube immovably fixed to said first endpiece and immovably fixed to said center support, a first extension arm slidable within said tube and extendable therefrom and normally biased in an outward direction, said first extension arm connected to a second endpiece, a first lifting flange attached to said first endpiece, a second lifting flange attached to said second endpiece, each of said lifting flanges projecting away from each other an effective distance to permit effective engagement with said inner ledge, each of said lifting flanges being engageable with said inner ledge so that said device is capable of lifting said manhole casting.

2. An adjustable lifting device according to claim 1, further comprising a collar in slidable and lockable engagement with said crosspiece capable of effectuating balancing of said device and casting.

3. An adjustable lifting device according to claim 2, said collar being slidable along the entire length of said crosspiece between said first endpiece and said center support.

4. An adjustable lifting device according to claim 1, further comprising a slide bar attached to said second endpiece, said slide bar being lockable to prevent retraction of said second endpiece.

5. An adjustable lifting device according to claim 4, said slide bar having a plurality of apertures each capable of receiving a stop pin.

6. An adjustable lifting device according to claim 1, further comprising a second extension arm slidable within said first extension arm and extendable therefrom, said second extension arm also being connected to said second endpiece.

7. An adjustable lifting device according to claim 6, wherein each of said first and second extension arms is springloaded.

8. An adjustable lifting device according to claim 7, wherein said first extension arm is actuated by a first spring which is dominant over a second spring which actuates said second extension arm.

9. An adjustable lifting device according to claim 1, each of said first and second endpieces having a safety stop attached above the lifting flange effective to prevent said device from dropping into said casting once said lifting flanges are positioned beneath said inner ledge, each of said safety stops projecting away from each other.

10. An adjustable lifting device according to claim 9, each of said safety stops being unobstructed from above.

11. An adjustable lifting device according to claim 1, each of said lifting flanges having an outer edge which is curved to accommodate a curved inner surface of a manhole casting.

12. An adjustable lifting device according to claim 1, said first extension arm having a locking element engageable with a lock attached to said second endpiece.

13. An adjustable lifting device according to claim 1, said first lifting flange immovably fixed to said first endpiece and immovably fixed in relationship to said crosspiece, said second lifting flange immovably fixed to said second endpiece.

14. An adjustable lifting device according to claim 1, wherein said first extension arm is spring-biased outwardly.

15. An adjustable lifting device according to claim 1, said tube having a bottom, said bottom defining a horizontal plane, each of said lifting flanges being adjacent said horizontal plane.

16. An adjustable lifting device according to claim 1, said second endpiece being extendable at least fifteen inches.

* * * * *

UNITED STATES PATENT AND TRADEMARK OFFICE

CERTIFICATE OF CORRECTION

PATENT NO. : 5,660,422

DATED : August 26, 1997

INVENTOR(S) : Jon C. Knisley

It is certified that error appears in the above-indentified patent and that said Letters Patent is hereby corrected as shown below:

Claim 1, line 2, after "comprising" insert --a--.

Signed and Sealed this

Thirtieth Day of December, 1997

*Attest:*

*Attesting Officer*

BRUCE LEHMAN

*Commissioner of Patents and Trademarks*